US006619617B2

(12) United States Patent
Ricco et al.

(10) Patent No.: US 6,619,617 B2
(45) Date of Patent: Sep. 16, 2003

(54) ELECTROMAGNETIC METERING VALVE FOR A FUEL INJECTOR

(75) Inventors: Mario Ricco, Casamassima (IT); Antonio Gravina, Bari (IT); Sergio Stucchi, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 209 days.

(21) Appl. No.: 09/725,941

(22) Filed: Nov. 30, 2000

(65) Prior Publication Data

US 2001/0015417 A1 Aug. 23, 2001

(30) Foreign Application Priority Data

Nov. 30, 1999 (IT) ..... TO99A1057

(51) Int. Cl.[7] ..... F02M 47/02

(52) U.S. Cl. ..... 251/129.16; 251/129.19; 239/585.1; 123/458

(58) Field of Search ..... 251/129.16, 129.19; 123/458, 472, 500, 501; 239/585.1, 585.3, 533.2, 533.3, 533.9

(56) References Cited

U.S. PATENT DOCUMENTS 5,381,999 A * 1/1995 Ricco ..... 251/129.16
5,820,101 A * 10/1998 Ricco ..... 251/129.16
6,126,094 A * 10/2000 Ricco ..... 239/585.1
6,161,813 A * 12/2000 Baumgartner et al. ..... 251/129.16 X
6,305,355 B1 * 10/2001 Hoffmann et al. ..... 123/458 X

FOREIGN PATENT DOCUMENTS

| | | | |
|---|---|---|---|
| DE | 197 08 104 | 9/1998 | |
| DE | 198 20 341 | 11/1999 | |
| EP | 0 890 731 | 1/1999 | |
| WO | WO-98/38426 A1 * | 9/1998 | ..... F02M/47/02 |

OTHER PUBLICATIONS

EPO Search Report dated Nov. 29, 2001.

* cited by examiner

*Primary Examiner*—Gene Mancene
*Assistant Examiner*—Eric Keasel
(74) *Attorney, Agent, or Firm*—Crowell & Moring LLP

(57) ABSTRACT

The metering valve has a shutter for a discharge conduit, and an electromagnet for controlling an armature disconnected from a relative stem and sliding along the stem by means of a sleeve. The armature is secured to the stem by a shoulder of the armature cooperating with a C-shaped ring fitted to the stem. A plate is interposed between the sleeve of the armature and a ring nut to reduce the overtravel of the armature, is locked transversely by a support of the electromagnet, and is kept resting on the ring nut by a compression spring. To secure the armature to the stem, the plate has an opening which is ineffective in reducing overtravel when the plate is moved transversely with respect to the armature.

7 Claims, 4 Drawing Sheets

ELECTROMAGNETIC METERING VALVE FOR A FUEL INJECTOR

The present invention relates to an electromagnetic metering valve for a fuel injector, in particular for internal combustion engines.

BACKGROUND OF THE INVENTION

Fuel injector metering valves normally comprise a control chamber having a discharge conduit closed by a shutter with the aid of a main spring; and the shutter is opened by energizing an electromagnet to overcome the action of the spring.

To reduce rebound of the arrested mass when the valve is closed, it has been proposed to disconnect the armature from the stem and provide a second spring by which the armature is pushed against the stem.

In one known metering valve in which the stem is guided by a fixed sleeve, the armature must be allowed fairly ample overtravel with respect to the stem to enable the armature to be fitted to the stem once the stem is inserted inside the fixed sleeve.

To reduce the time interval between two consecutive operations of the armature—as required, for example, in multiple-injection engines, i.e. with injection systems capable of multiple injections in each cylinder at each combustion cycle—it has been proposed to minimize the overtravel of the armature with respect to the stem by fitting a C-shaped bush to the stem after it is connected to the armature.

The bush has the drawback of not being locked positively in its seat and therefore becoming unseated. Also, not being secured axially, the bush tends, in use, to oscillate together with, and so prolong oscillation of the armature.

SUMMARY OF THE INVENTION

It is an object of the invention to provide a metering valve of the above type, which is highly straightforward and reliable, provides for eliminating the aforementioned drawbacks typically associated with known valves, and provides for rapid arrest of the armature in the valve opening position.

According to the present invention, there is provided an electromagnetic metering valve for a fuel injector, comprising a shutter for a discharge conduit of a control chamber, an electromagnet for activating an armature to control said shutter via an intermediate member, and a first spring acting on said intermediate member to keep said shutter in the closed position; said armature being disconnected from said intermediate member and being pushed against the intermediate member by a second spring; and stop means, independent of said shutter, being provided to arrest the movement of said armature produced by said first spring so as to reduce the overtravel of said armature with respect to the travel of said intermediate member; characterized in that said stop means comprise at least one plate which is locked transversely with respect to said intermediate member.

More specifically, the plate is locked transversely by a fastening member of the electromagnet, and is kept resting elastically against a fixed stop by said second spring.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
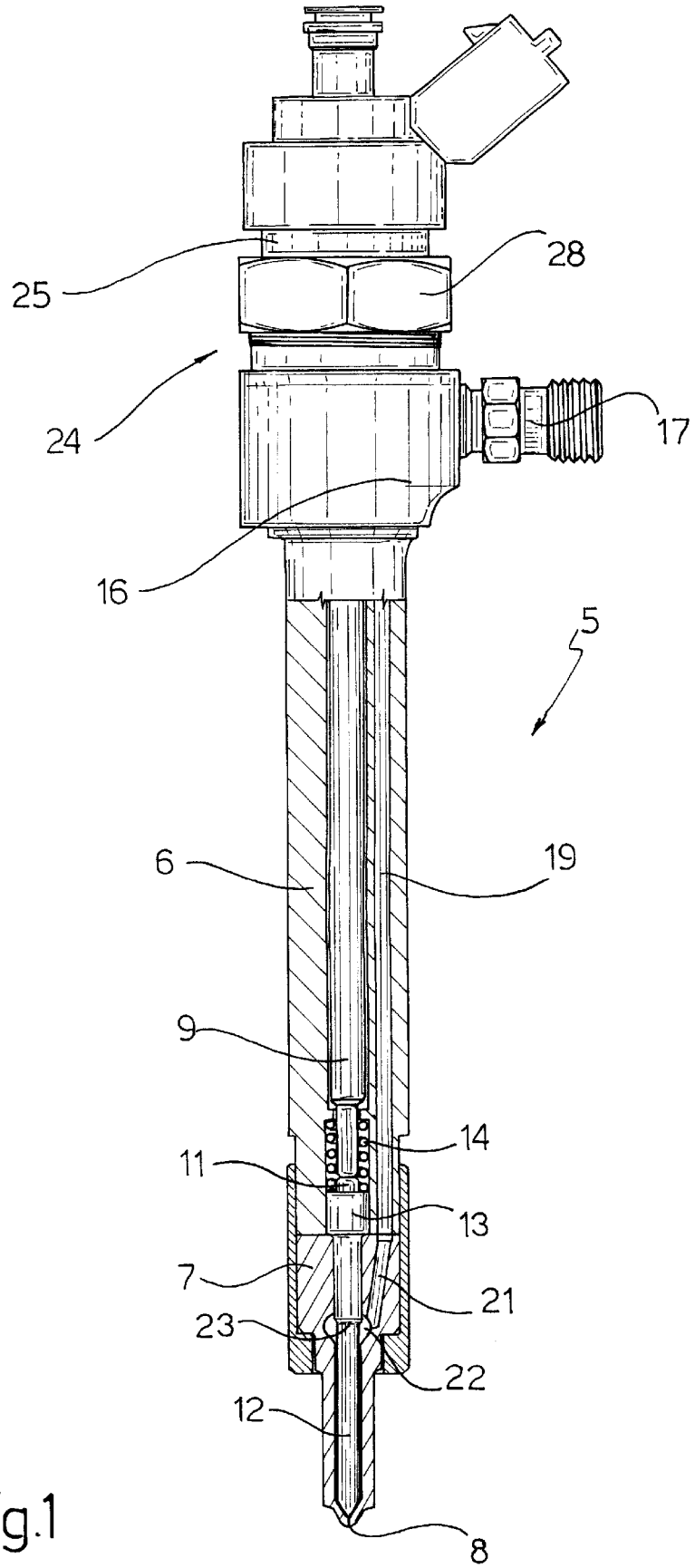
FIG. 1 shows a partially sectioned side view of a commercial fuel injector incorporating a metering valve in accordance with the invention.

Number 5 in FIG. 1 indicates as a whole a fuel injector, e.g. for a diesel internal combustion engine. Injector 5 comprises a hollow body 6 connected to a nozzle 7 terminating with a number of—typically four or eight—injection holes 8. A control rod 9 slides inside body 6 and engages an appendix 11 of a pin 12 for closing injection holes 8. Pin 12 also comprises a collar 13 normally pushed by a spring 14 which assists in keeping injection holes 8 closed.

Hollow body 6 also comprises an appendix 16 in which is inserted an inlet fitting 17 connected to the usual pressurized fuel supply conduit. Appendix 16 comprises a hole 18 (see also FIG. 2) communicating via conduits 19 and 21 with an injection chamber 22 of nozzle 7; and pin 12 has a shoulder 23 on which the pressurized fuel in chamber 22 acts.

Figure 2:
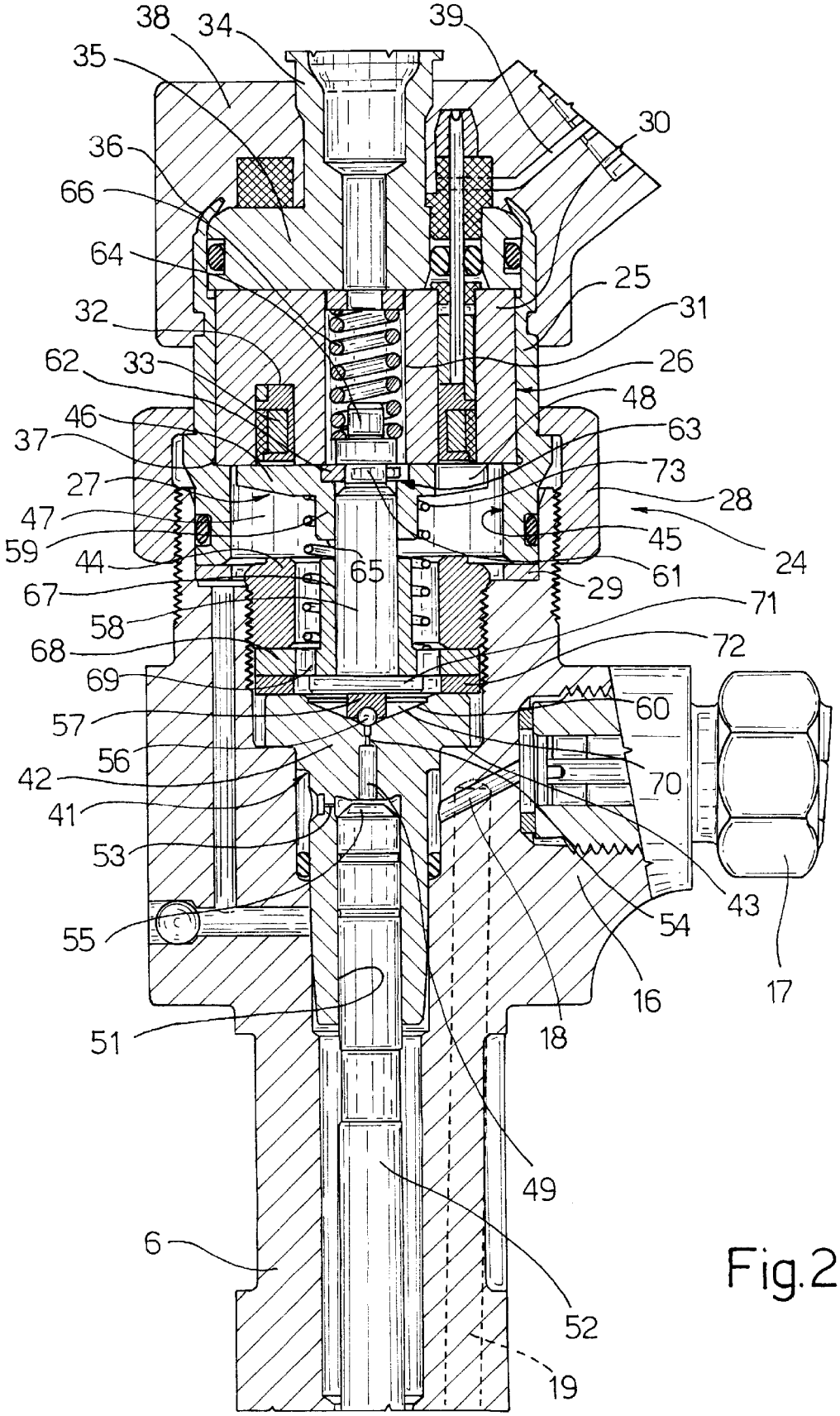
FIG. 2 shows a larger-scale, partial mid-section of the commercial injector in FIG. 1.

Injector 5 also comprises a metering valve indicated as a whole by 24 and which in turn comprises a sleeve 25 supporting an electromagnet 26 controlling an armature 27 (FIG. 2).

Sleeve 25 is fixed to body 6 by a threaded ring nut 28, which engages an external thread on body 6 via the interposition of a calibrated washer 29.

Electromagnet 26 has an annular magnetic core 30 defining a central hole 31; an annular seat 32 of core 30 houses the usual electric coil 33 for activating electromagnet 26; and central hole 31 of core 30 is coaxial with a discharge conduit 34 carried by a cylindrical body 35 and connected by a conduit to the fuel tank.

Core 30 is fixed to body 6, together with cylindrical body 35, by bending an edge 36 of supporting sleeve 25 so that core 30 engages a shoulder 37 of sleeve 25; and a base 38 of insulating material supporting the usual pins 39 of coil 33 is molded in known manner on sleeve 25.

Metering valve 24 also comprises a body 41 having a flange 42, which is normally maintained resting on a shoulder 43 of injector body 6 by an externally threaded ring nut 44 screwed to an internal thread of body 6 as explained in more detail later on.

Armature 27 substantially comprises a disk 46 housed inside a discharge chamber 47 of metering valve 24 defined by a cylindrical surface 45 of sleeve 25. Disk 46 has three sectors separated by three openings 48 through which discharge chamber 47 communicates with central hole 31 of core 30. Body 41 of valve 24 also comprises an axial control chamber 49 communicating with a hole 51 in which a portion 52 of rod 9 slides in fluidtight manner; a calibrated inlet conduit 53 communicating with hole 18 of appendix 16; and a discharge conduit 54 communicating with discharge chamber 47.

Portion 52 of rod 9 has an end surface 55 on which the pressurized fuel in control chamber 49 acts; surface 55 and the bottom surface of hole 51 are so formed that inlet conduit 53 communicates at all times with control chamber 49; and, the area of surface 55 of rod 9 being greater than that of shoulder 23 (see also FIG. 1), the pressure of the fuel, assisted by spring 14, normally keeps rod 9 so positioned as to close injection holes 8 of nozzle 7.

Discharge conduit 54 of control chamber 49 is normally kept closed by a shutter in the form of a ball 56, which rests on a contact plane of a conical surface 60 at which conduit 54 terminates. Ball 56 is engaged by a guide plate 57 on which acts an intermediate member defined by a cylindrical stem 58.

Disk 46 of armature 27 is integral with a sleeve 59 sliding axially on stem 58 and having an end surface 65. Stem 58 has a groove 61 housing a C-shaped ring 62 cooperating with a shoulder 63 of disk 46, which may, however, disengage from ring 62 so that disk 46 of armature 27 is detached from stem 58. Stem 58 extends a given length inside hole 31 and terminates with a small-diameter portion 64 for supporting and anchoring a first compression spring 66 housed inside hole 31.

Stem 58 slides inside a guide sleeve 67, which is integral with a flange 68 having axial holes 69 for connecting a chamber 70, located between flange 68 and conical surface 60, to the discharge chamber 47. At the bottom, stem 58 has an integral flange 71 housed inside chamber 70 and which is arrested against the bottom surface of fixed flange 68.

Flange 68 is forced by ring nut 44 against flange 42 of body 41 of valve 24, so that sleeve 67 is fixed; a calibrated washer 72 is interposed between flange 68 and flange 42 to define the desired travel of stem 58; and spring 66 is precompressed to move stem 58 and armature 27 rapidly towards body 41 when electromagnet 26 is energized, and to keep shutter 56, by means of plate 57, in the closed position closing conduit 54.

In the commercial injector shown in FIG. 2, a second compression spring 73 is located between disk 46 of armature 27 and flange 68 of guide sleeve 67, and acts on disk 46 to keep it normally positioned with shoulder 63 resting against ring 62 on stem 58. The action of spring 66, however, is greater than that of spring 73. Sleeve 59 of disk 46 must be separated by a given distance D from guide sleeve 67 (see also FIG. 3*b*) to permit insertion of ring 62 inside groove 61 after fitting stem 58 inside guide sleeve 67, fixing flange 68 by means of ring nut 44, and fitting spring 73 to sleeve 67 and sleeve 59 to stem 58.

In the commercial injector described so far, when spring 66 activates stem 58 to return ball 56 to the closed position, ball 56 is arrested together with stem 58 by conical surface 60 of valve body 41. By means of C-shaped ring 62, stem 58 takes with it armature 27, which tends to keep moving downwards by force of inertia and to overtravel within distance D. Armature 27 is then brought by spring 73 back into position with shoulder 63 resting against ring 62, and is finally arrested after a certain amount of relatively severe, relatively prolonged oscillation, during which it is unable to respond to the next excitation of electromagnet 26.

Figure 3A:
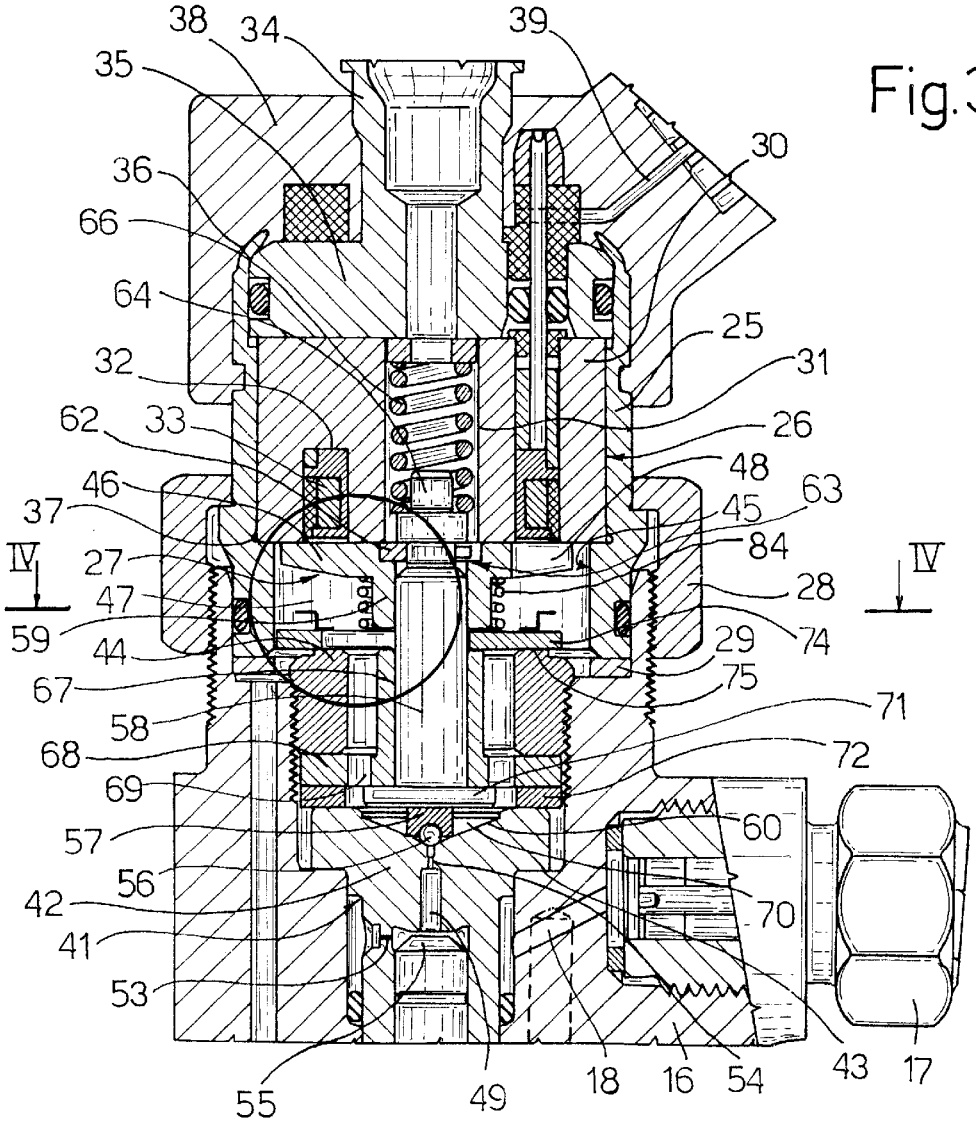
FIG. 3*a* shows a larger-scale portion of the FIG. 2 section comprising the metering valve according to the invention.
Figure 3B:
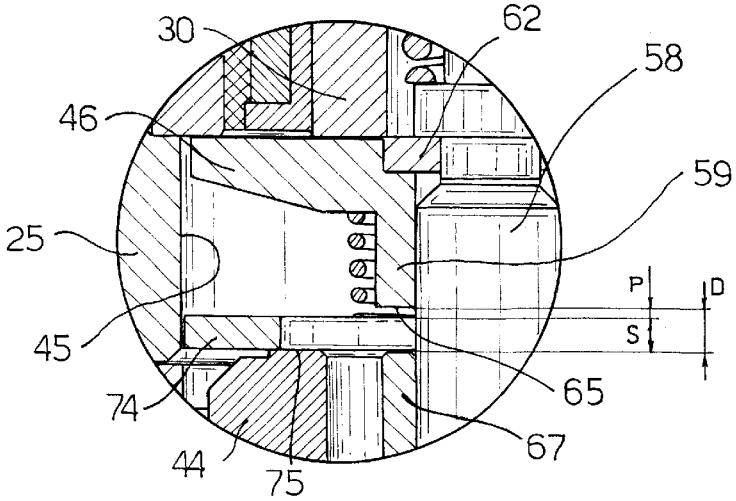
FIG. 3*b* shows a much larger-scale detail of FIG. 3*a;*

The component parts of the FIG. 3*a* injector indicated using the same reference numbers as in FIG. 2 are structurally and functionally the same as those described above and therefore require no further explanation. According to the invention, to reduce the overtravel of armature 27 and arrest it rapidly in the closed position closing valve 24, a stop member defined by a plate 74 of calibrated thickness S is provided between an end surface 75 of ring nut 44 and end surface 65 of sleeve 59 of armature 27. Plate 74 is made of extremely hard nonmagnetic material, and may be of any metal material, e.g. case-hardened steel.

Plate 74 is shaped to comprise a first sector 76 (FIGS. 4 and 5) of over 180° and of substantially the same diameter as cylindrical surface 45 of sleeve 25, so that plate 74 is locked by sleeve 25. Sector 76 is symmetrical with respect to an axis 77, and plate 74 has an opening 78 comprising a substantially semicircular first portion 79, which is concentric with sector 76, is also symmetrical with respect to axis 77, and is engaged by stem 58.

Thickness S of plate 74 (FIG. 3*b*) is precisely calibrated to form with surface 65 of sleeve 59 a predetermined axial clearance P, which is much smaller than distance D, is extremely small and corresponds to the desired overtravel of armature 27, and may preferably be less than 20 microns.

Opening 78 also comprises a sector-shaped second portion 81, which is also symmetrical with respect to axis 77, is of a diameter greater than the outside diameter of sleeve 59, is eccentric with respect to portion 79 by eccentricity E, and is connected to portion 79 by two parallel portions 82. Preferably, the diameter of portion 81 is twice eccentricity E.

Plate 74 also comprises a second sector 83 concentric with portion 81 of opening 78, and the edge of which is connected to the edge of sector 76. A compression spring 84 (FIG. 3*a*) is located between plate 74 and disk 46 to perform the same function on disk 46 as spring 73 of the commercial injector in FIG. 2. The turns of spring 84 are larger in diameter than portion 81 of opening 78 to prevent spring 84 from slipping through opening 78. In actual use, spring 84 keeps plate 74 resting elastically on surface 75 of ring nut 44, and prevents plate 74 from oscillating axially when sleeve 59 of armature 27 is arrested.

To assemble valve 24, valve body 41 is inserted inside body 6; calibrated washer 72 is placed on flange 42, and ball 56 with plate 57 on conical surface 60; sleeve 67 is inserted inside ring nut 44, and stem 58 inside sleeve 67; ring nut 44 is screwed to the internal thread on body 6 to secure sleeve 67; plate 74 is placed on ring nut 44, and spring 84 on plate 74; and, finally, sleeve 59 of armature 27 is fitted onto stem 58.

Figure 4:
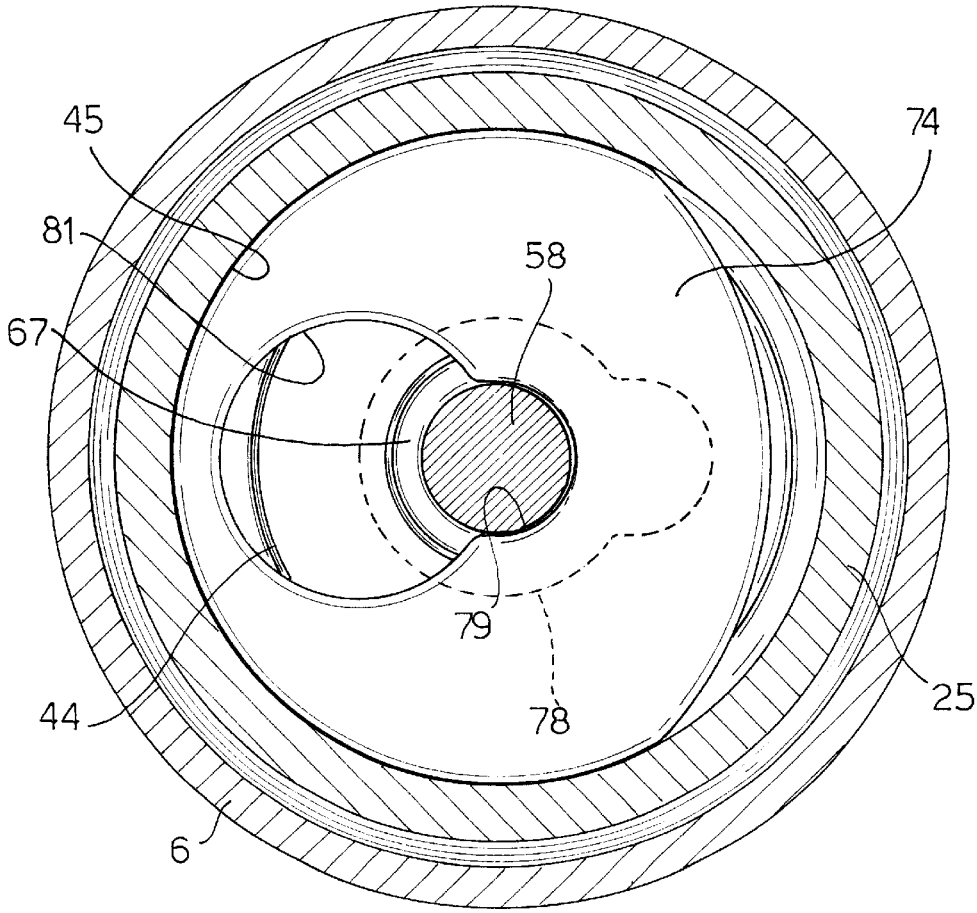
FIG. 4 shows a section along line IV—IV in FIG. 3*a;*
Figure 5:
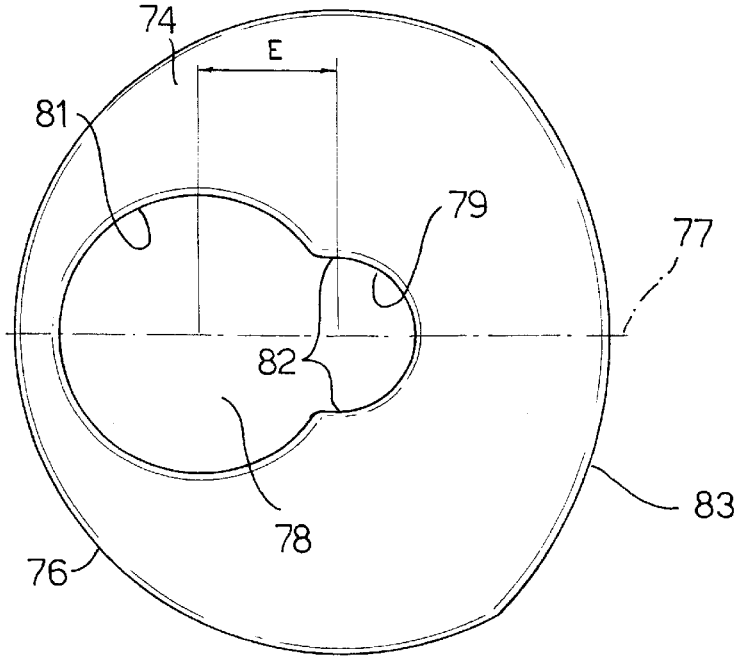
FIG. 5 shows a larger-scale plan view of a detail in FIG. 4.

To insert C-shaped ring 62 inside groove 61 on stem 58, plate 74 is moved crosswise with respect to stem 58 and parallel to axis 77 so that portion 81 of opening 78 is coaxial with stem 58, as shown by the dash line in FIG. 4. Then, in opposition to spring 84 (see also FIG. 3*a*), disk 46 of armature 27 is forced the whole of distance D towards sleeve 67 and past groove 61 on stem 58.

Ring 62 is then inserted inside groove 61 and disk 46 released; spring 84 brings the disk to rest on ring 62; and plate 74 is moved along axis 77 so that portion 79 of opening 78 engages stem 58. This assembly forms the movable part of electromagnet 26 and is tested before assembling the rest of the injector.

Apart, core 30 of electromagnet 26, together with body 35 of discharge conduit 34, is fitted inside supporting sleeve 25 by bending edge 36, and this fixed part of electromagnet 26 also tested separately. Washer 29 is inserted inside body 6; supporting sleeve 25, together with the fixed part of electromagnet 26, is inserted inside body 6, so that the inner surface 45 of sleeve 25 now locks plate 74 transversely; and, finally, sleeve 25 is fixed to body 6 by means of ring nut 28.

Injector 5 described operates as follows.

When coil 33 is energized (FIG. 3*a*), core 30 attracts armature 27, which, by means of shoulder 63 and ring 62, draws stem 58 positively along with it in opposition to spring 66. The pressure of the fuel in chamber 49 therefore opens shutter 56, so that the fuel in chamber 49 is discharged into discharge chamber 47 and along conduit 34 back into the tank. In turn, the pressure of the fuel in chamber 22 (see also FIG. 1) overcomes the residual pressure on end surface 55 of rod 9 and raises pin 12, so that fuel is injected into chamber 22 through injection holes 8.

When coil 33 is deenergized, spring 66 clicks down stem 58, which, by means of ring 62, takes armature 27 with it. The kinetic energy of stem 58 is partly dissipated by the turbulence generated by flange 71 in the fuel in chamber 70, thus softening the impact of stem 58, plate 57 and ball 56. Ball 56 thus closes discharge conduit 54, and the pressurized fuel restores the pressure inside control chamber 49 so that pin 12 closes injection holes 8.

When stem 58 is arrested, armature 27 continues moving by force of inertia in opposition to spring 84, and overtravels with respect to the travel of stem 58 to close shutter 56. Surface 65 of sleeve 59 is arrested on plate 74 and rebounds and oscillates as a result of spring 84, but the movement of armature 27 is limited to the small clearance P between plate 74 and surface 65 of sleeve 59.

Moreover, being kept resting on ring nut 44 at all times by spring 84, plate 74 does not accompany or in any way amplify the oscillation of armature 27, so that the kinetic energy of armature 27 is greatly reduced, rebound in both directions is damped rapidly, and the interval between deenergizing coil 33 and the next fuel injection operation of armature 27 is also greatly reduced.

The advantages, as compared with known technology, of metering valve 24 according to the invention will be clear from the foregoing description. That is, plate 74 provides for arresting armature 27 rapidly on ring 62 to reduce the interval between two consecutive operations of armature 27 and so enable rapid consecutive multiple injections in each engine cylinder in the same combustion cycle.

Moreover, plate 74 is firmly seated by being locked transversely at all times by the inner surface 45 of sleeve 25, and, in use, does not accompany the oscillation of armature 27 by being kept resting at all times on a fixed stop defined by ring nut 44.

Clearly, changes may be made to the metering valve as described herein without, however, departing from the scope of the accompanying Claims. For example, plate 74 and opening 78 may be formed differently from those described; spring 84 may be replaced with a leaf spring or by one or more Belleville washers; and sleeve 25 may be designed to screw directly onto a corresponding external thread on body 6.

What is claimed is:

1. An electromagnetic metering valve for a fuel injector, comprising a shutter for a discharge conduit of a control chamber, an electromagnet for activating an armature to control said shutter via an intermediate member, and a first spring acting on said intermediate member to keep said shutter in the closed position; said armature being disconnected from said intermediate member and being pushed against the intermediate member by a second spring; and stop means, independent of said shutter, being provided to arrest the movement of said armature produced by said first spring so as to reduce the overtravel of said armature with respect to the travel of said intermediate member; wherein said stop means comprise at least one plate which is locked traversely with respect to said intermediate member, and wherein said armature comprises a disk integral with a first sleeve, and said intermediate member is in the form of a stem coaxial with said disk; said sleeve sliding on said stem; wherein said plate engages said stem and is of calibrated thickness (S); said plate being so shaped as to comprise a sector greater than 180°, so as to be locked by a cylinder inner surface of said fastening member.

2. A valve as claimed in claim 1, wherein said plate is so locked by a fastening member of said electromagnet; said plate being kept resting elastically against a fixed stop by said second spring.

3. A valve as claimed in claim 1, wherein said stem is guided by a second sleeve fixed by a ring nut inside a discharge chamber; wherein said plate is kept resting on said ring nut by said second spring.

4. A valve as claimed in claim 1, wherein said plate has an opening comprising a semicircular first portion engaged by said stem, and a sector-shaped second portion eccentric with respect to said first portion to permit assembly of said disk onto said stem.

5. A valve as claimed in claim 4, wherein the turns of said second spring are larger in diameter than said second portion.

6. A valve as claimed in claim 4, wherein said stem slides axially in said disk and is fitted to said disk by an axial displacement of a given distance (D) in opposition to said second spring; wherein said plate arrests said disk after a predetermined travel (P) much smaller than said distance (D); said second portion being temporarily alignable with said stem to permit said axial displacement.

7. A valve as claimed in claim 6, wherein said plate is located between an end surface of said ring nut and an end surface of the sleeve of said armature; said thickness (S) being such that said predetermined travel (P) is less than 20 microns.

* * * * *